US007963698B2

(12) United States Patent
Grazziotin

(10) Patent No.: US 7,963,698 B2
(45) Date of Patent: Jun. 21, 2011

(54) BAG FORMED BY A SET OF DETACHABLE BAGS

(76) Inventor: Fernando Alberto Grazziotin, Passo Fundo (BR)

( * ) Notice: Subject to any disclaimer, the term of this patent is extended or adjusted under 35 U.S.C. 154(b) by 406 days.

(21) Appl. No.: 10/599,206

(22) PCT Filed: Mar. 14, 2005

(86) PCT No.: PCT/BR2005/000032

§ 371 (c)(1),
(2), (4) Date: Sep. 22, 2006

(87) PCT Pub. No.: WO2005/090206

PCT Pub. Date: Sep. 29, 2005

(65) Prior Publication Data

US 2008/0279486 A1 Nov. 13, 2008

(30) Foreign Application Priority Data

Mar. 23, 2004 (BR) ..... 0400096

(51) Int. Cl.
*B65D 30/08* (2006.01)
*B65D 25/14* (2006.01)

(52) U.S. Cl. ..... 383/111; 383/109; 383/105; 383/32; 383/37; 220/495.07; 220/908.1

(58) Field of Classification Search ..... 220/908, 220/908.1, 495.07, 495.11; 206/554, 507; 383/37, 32, 109, 111; 493/93, 101; 53/446
See application file for complete search history.

(56) References Cited

U.S. PATENT DOCUMENTS

| | | | | | |
|---|---|---|---|---|---|
| 3,198,325 | A * | 8/1965 | White | 206/493 |
| 3,212,681 | A * | 10/1965 | Weikert | 222/183 |
| 3,512,338 | A * | 5/1970 | Nestler | 383/37 |
| 3,888,406 | A | 6/1975 | Nippes | |
| 4,349,123 | A | 9/1982 | Yang | |
| 4,978,231 | A * | 12/1990 | Ling et al. | 383/37 |
| 5,363,980 | A * | 11/1994 | Mulcahy | 383/37 |
| 6,102,239 | A * | 8/2000 | Wien | 383/37 |
| 7,080,751 | B2 | 7/2006 | Grazziotin | |
| 2003/0141303 | A1 * | 7/2003 | Grazziotin | 220/484 |

FOREIGN PATENT DOCUMENTS

JP 07 315502 A 12/1995

* cited by examiner

*Primary Examiner* — Justin M Larson
*Assistant Examiner* — Peter Helvey
(74) *Attorney, Agent, or Firm* — Brooks Kushman P.C.

(57) ABSTRACT

The present invention is a bag (1) composed of multiple removable bags (10) (9) (8) (7) (6) (5), forming a set (1) with bags disposed in layers (5). It is designed to be used especially in places that accumulate and/or collect grit/dirt, both in hydraulic plants and in isolated places, such as trash cans and temporary toilets. It is also appropriate for places where products are separated manually. It resolves the difficulties of the first steps of placement of bags end reduces the time spent on carrying out maintenance, bringing benefits both due to its lower cost and the less time of exposure to an uncomfortable body position for its users. The set (1) is set in place, and the innermost bag (10) of the set is removed after being used, taking with it its contents; after that, the place is immediately ready for use. After the first bag is used and removed, the second ,0g (9) is, and so forth, until all the bags have been used.

5 Claims, 6 Drawing Sheets

Fig. 2
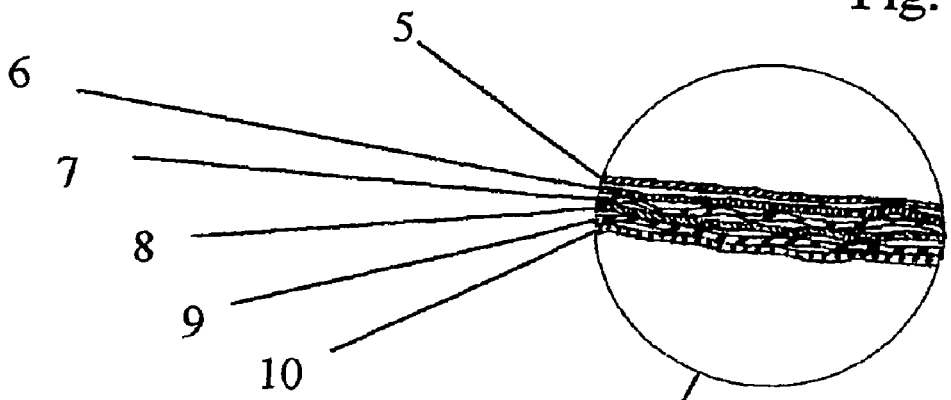
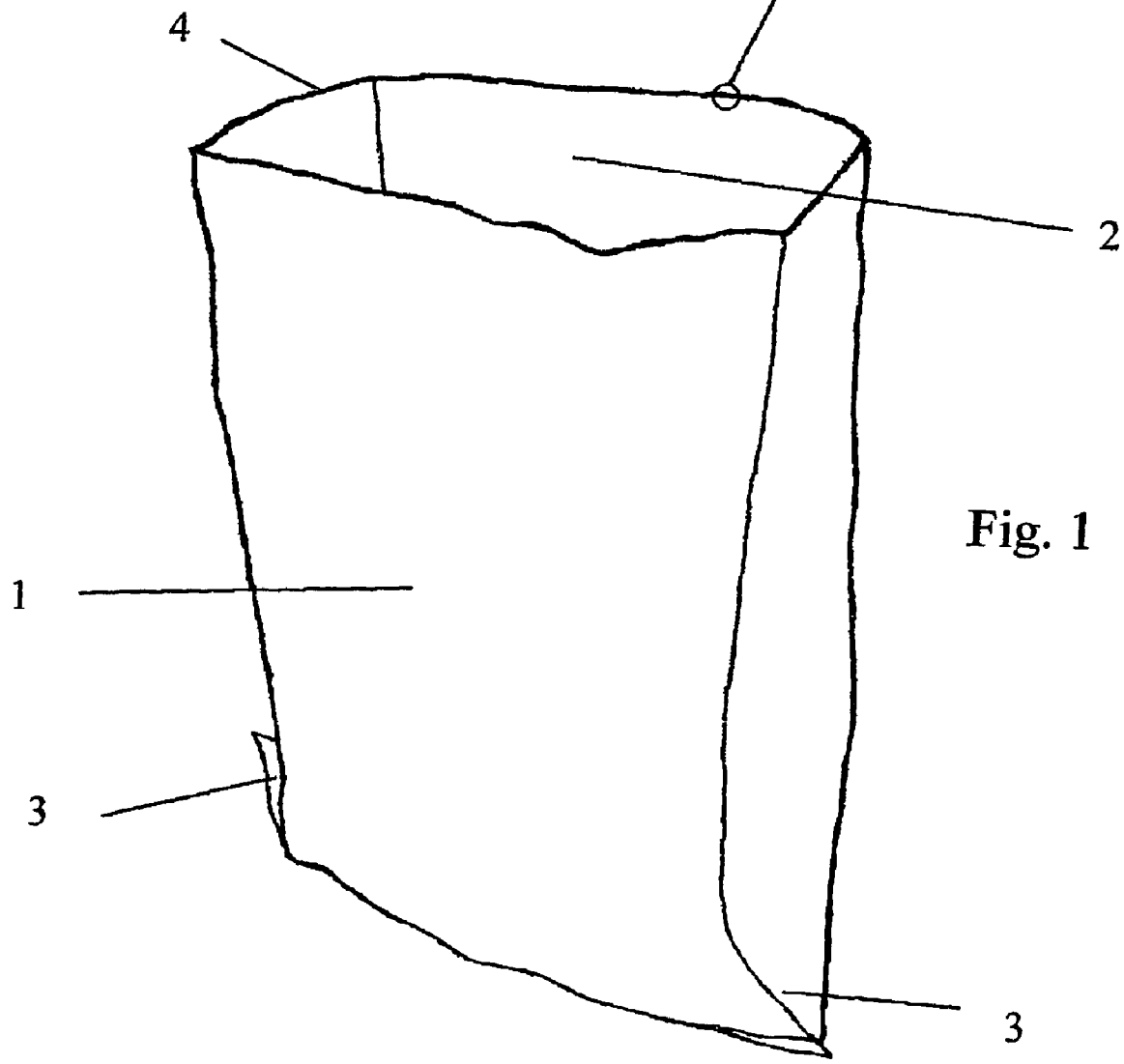
Fig. 1

Fig. 6
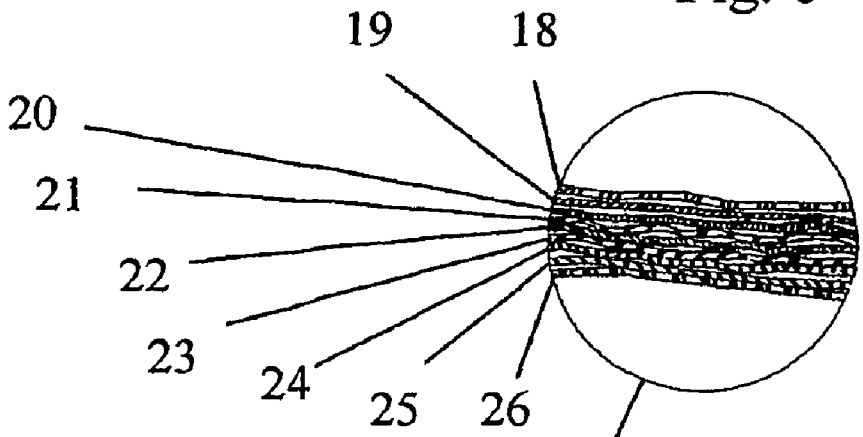
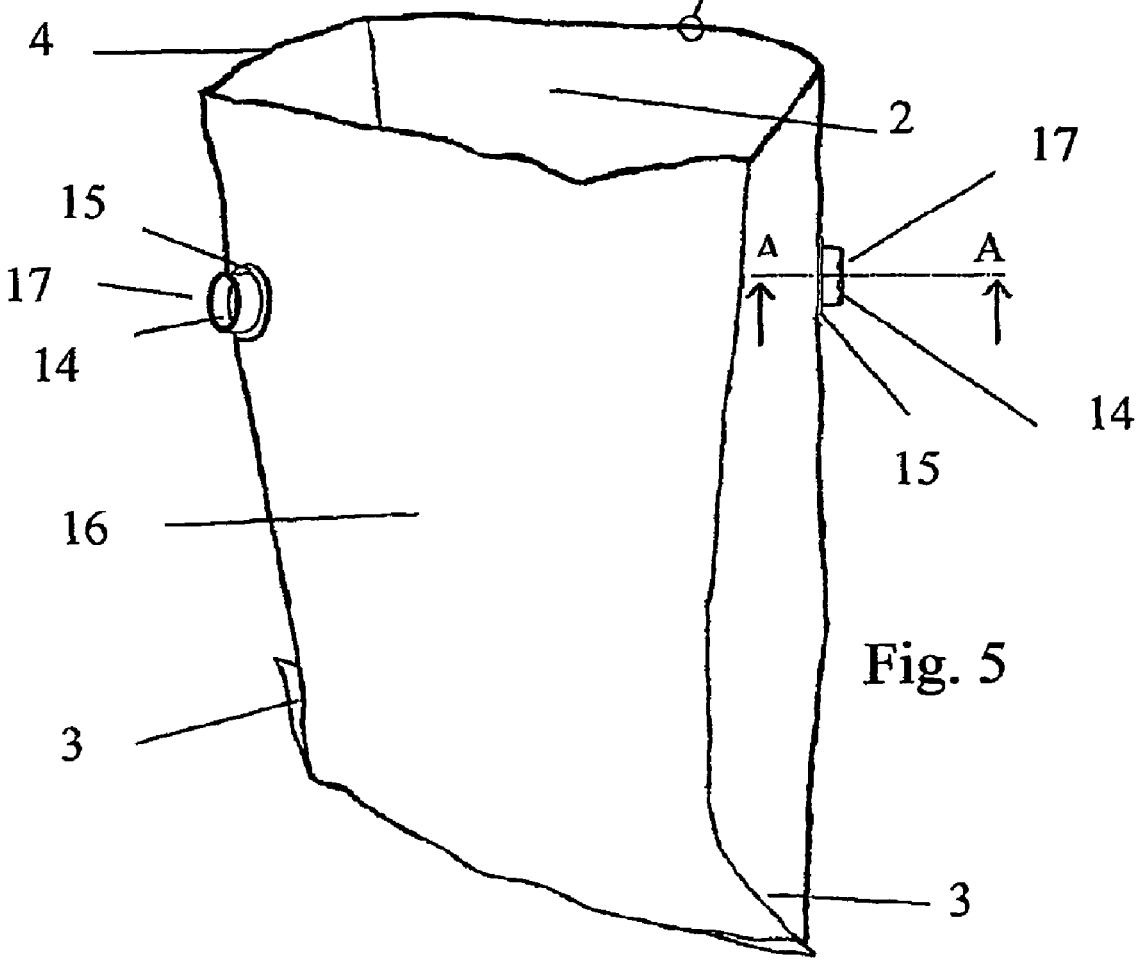
Fig. 5

Fig. 8
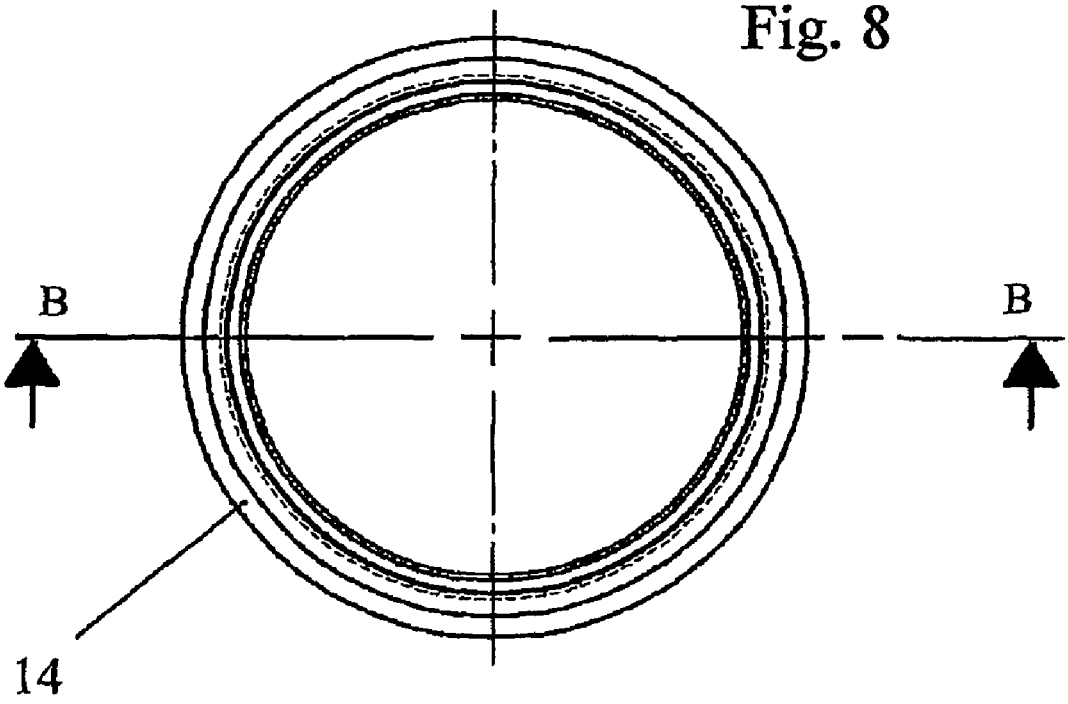
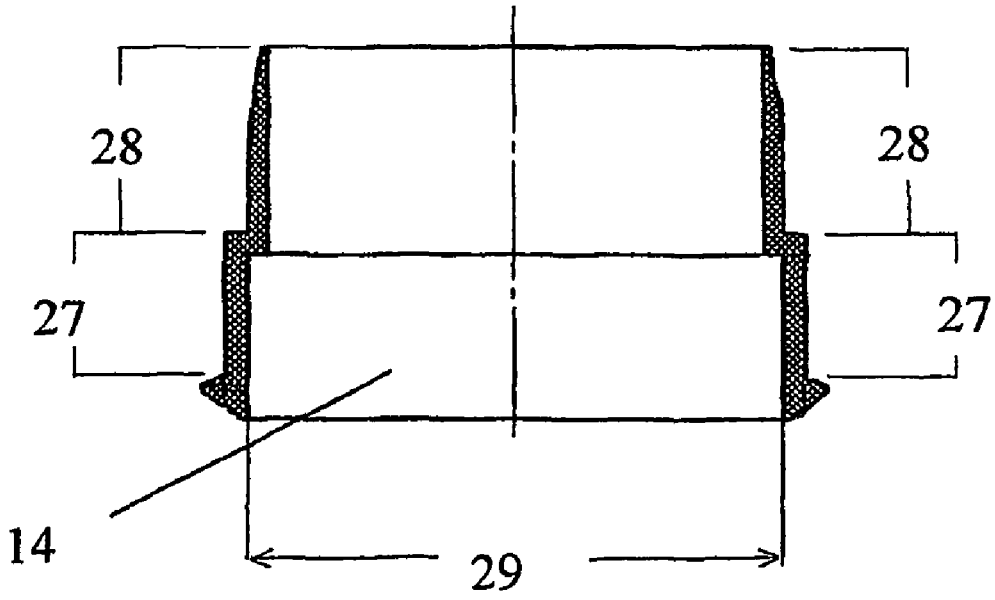
Fig. 9

BAG FORMED BY A SET OF DETACHABLE BAGS

BACKGROUND OF THE INVENTION

1. Field of the Invention

The present invention is a bag assembly formed by a set of multiple detachable bags set in layers, each within the subsequent ones. The set is designed to be placed in places where grit/dirt is accumulated and/or collected, both in hydraulics plants of buildings, crossover boxes, grease retainer, drains, etc. as well as in isolated places, such as trash cans and temporary toilets. It is also designed to be placed where products are placed in bags, such as those used for sorting out fruits, vegetables and other products chosen and separated by customers in supermarkets. Its use starts with the placement of the set wherever desired, followed by the subsequent removal of one bag at a time; the bag removed takes within it whatever users want, and the next bag in the set is instantly prepared for use; this procedure can be repeated until all bags have been used.

2. Background Art

Present bags found in the market and designed for the same purpose as that of the present invention are sold/supplied in single units or in multiple units, and, when multiple, are rolled up, one over the other, or piled up, also one over the other; this results in bags having to be put in place one by one. For example, patent WO 03/017807 presents a solution in which the plastic bags are laterally overlapped and have holes in their upper part so that they can be easily placed, resulting in better filling.

Some bags are simple and have one opening only in their upper end, which is the case of bags designed to be used in trash cans. Other bags may also have lateral openings, such as the bags mentioned in Letters Patent PI9801250 and C19801250, designed for use in hydraulic plants; both PI9801250 and C19801250 are Brazilian and are included in request PCT/BR99/00031, which issued as U.S. Pat. No. 7,080,751.

Presently, what demands more time and poses greater difficulty for users is the placement of bags in containers. U.S. Pat. No. 4,349,123 aims at solving this problem, by introducing a collector with plastic bags overlapped within the container itself.

As to each individual bag, users have to locate and fetch the bag, not only having to take it to its destination, but also to open it and fit it in place.

Sometimes, at first, users are not sure where the openings of bags are located. Other times, although they know where the opening is located, it is difficult for users to initiate the separation of the edges of the bag so as to open it, especially when the bag walls are very pliable and thin, being, for example, 0.02 millimeters thick.

Moreover, in other cases, the handling and placement of bags results in air trapped between the walls of the bag and the walls of its container, which hinders the process of placement and accommodation of bags in containers, because, instead of flowing out of the container, the air moves internally, causing the displacement of some parts of the bag towards the opposite of where desired. The same happens whenever the bag walls are pushed towards the walls of their containers, or when the bags are put one within the other in the same container.

SUMMARY OF THE INVENTION

The objectives of the present invention are to facilitate the placement of bags and to reduce the amount of time employed by users, resulting in benefits both in terms of lower costs and the less time users spend in uncomfortable body positions.

BRIEF DESCRIPTION OF THE DRAWINGS

FIG. 1 is a front perspective view of a bag assembly;

FIG. 2 is an enlarged partial plan view of the bag assembly of FIG. 1;

FIG. 5 is a front perspective view of a hydraulic plant bag assembly;

FIG. 6 is an enlarged partial plan view of the hydraulic plant bag assembly of FIG. 5;

FIG. 8 is an enlarged front view of a bushing of the hydraulic plant bag assembly of FIG. 5; and FIG. 9 is a section view BB of the bushing of FIG. 8.

DETAILED DESCRIPTION OF THE PREFERRED EMBODIMENTS

Figure 3:
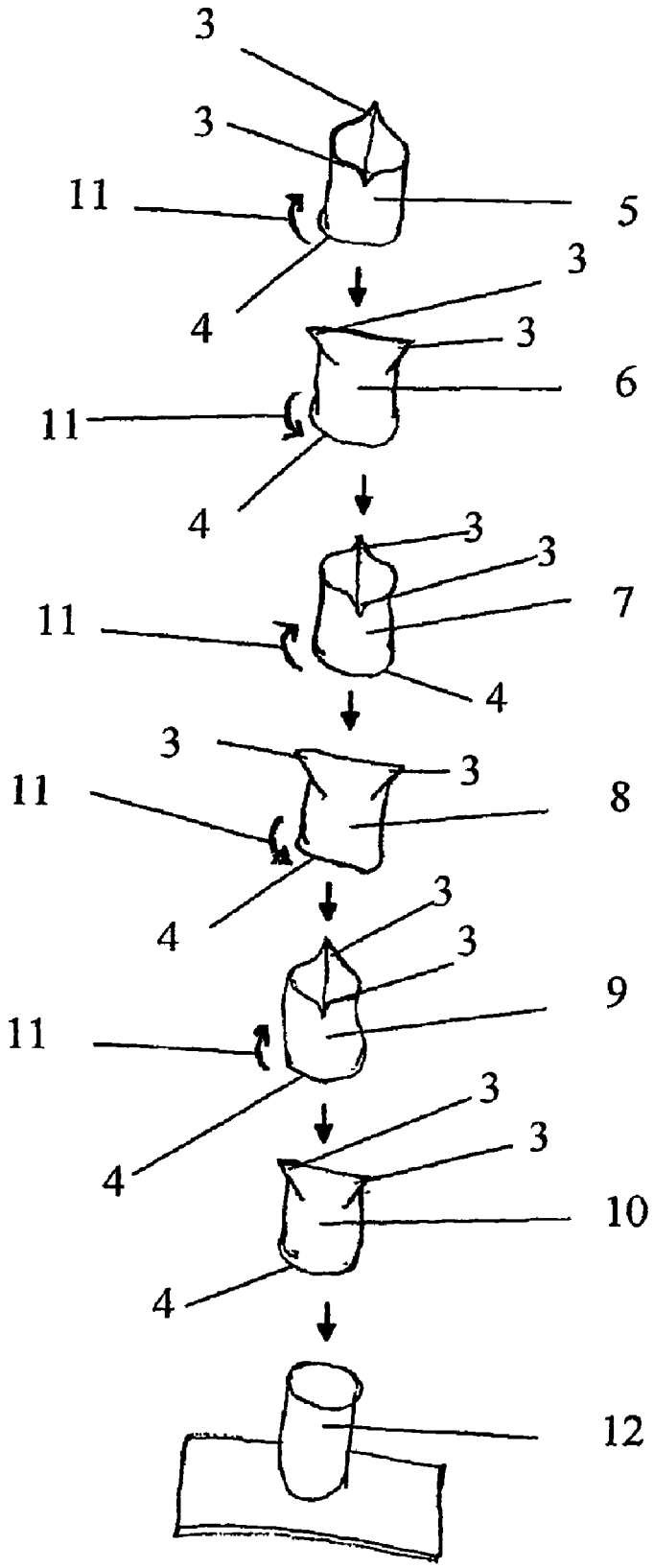
FIG. 3 is a diagram illustrating a mounting sequence for the bag assembly of FIG. 1.
Figure 4:
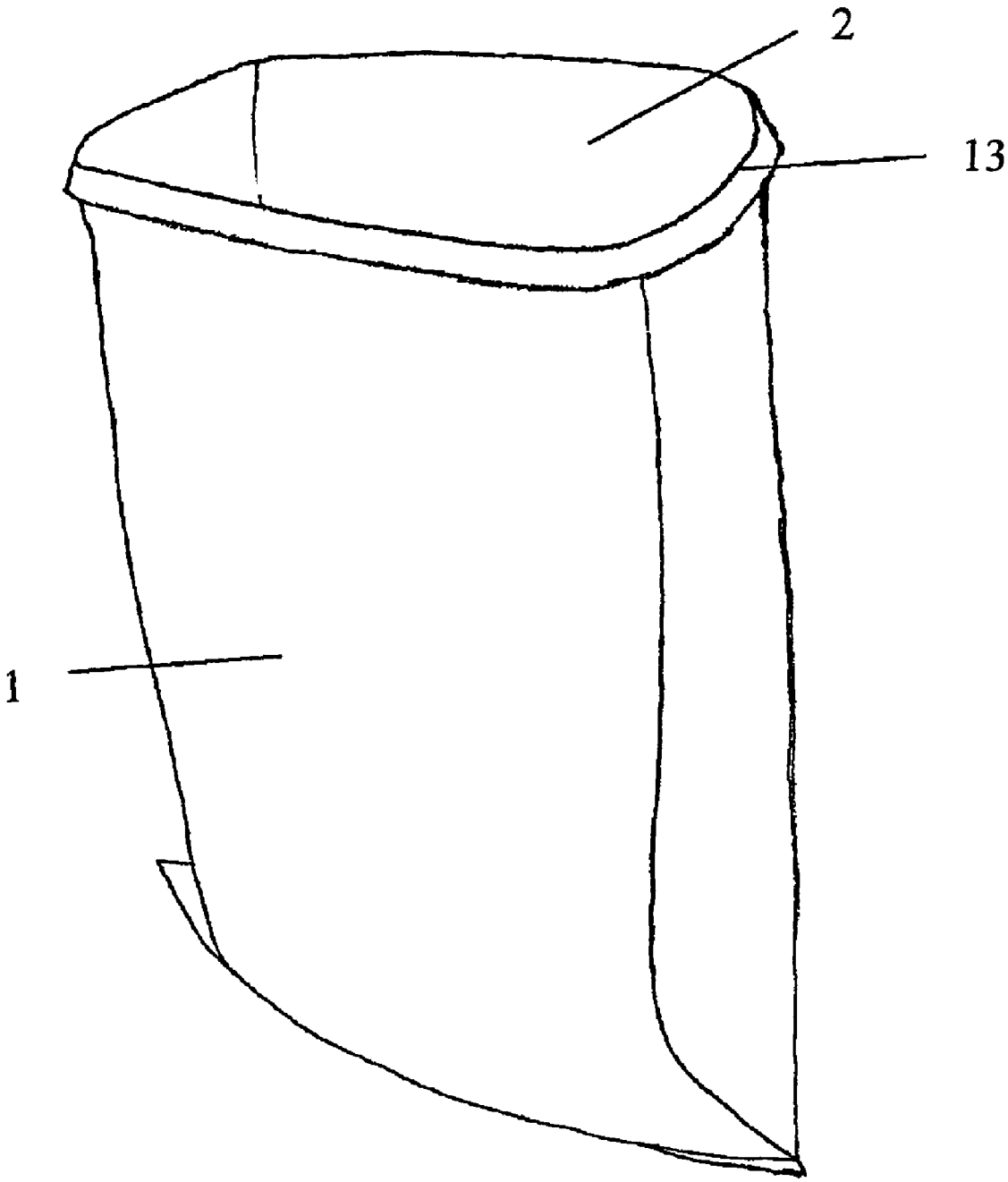
FIG. 4 is another front perspective view of the bag assembly of FIG. 1, illustrated with a folded edge.
Figure 7:
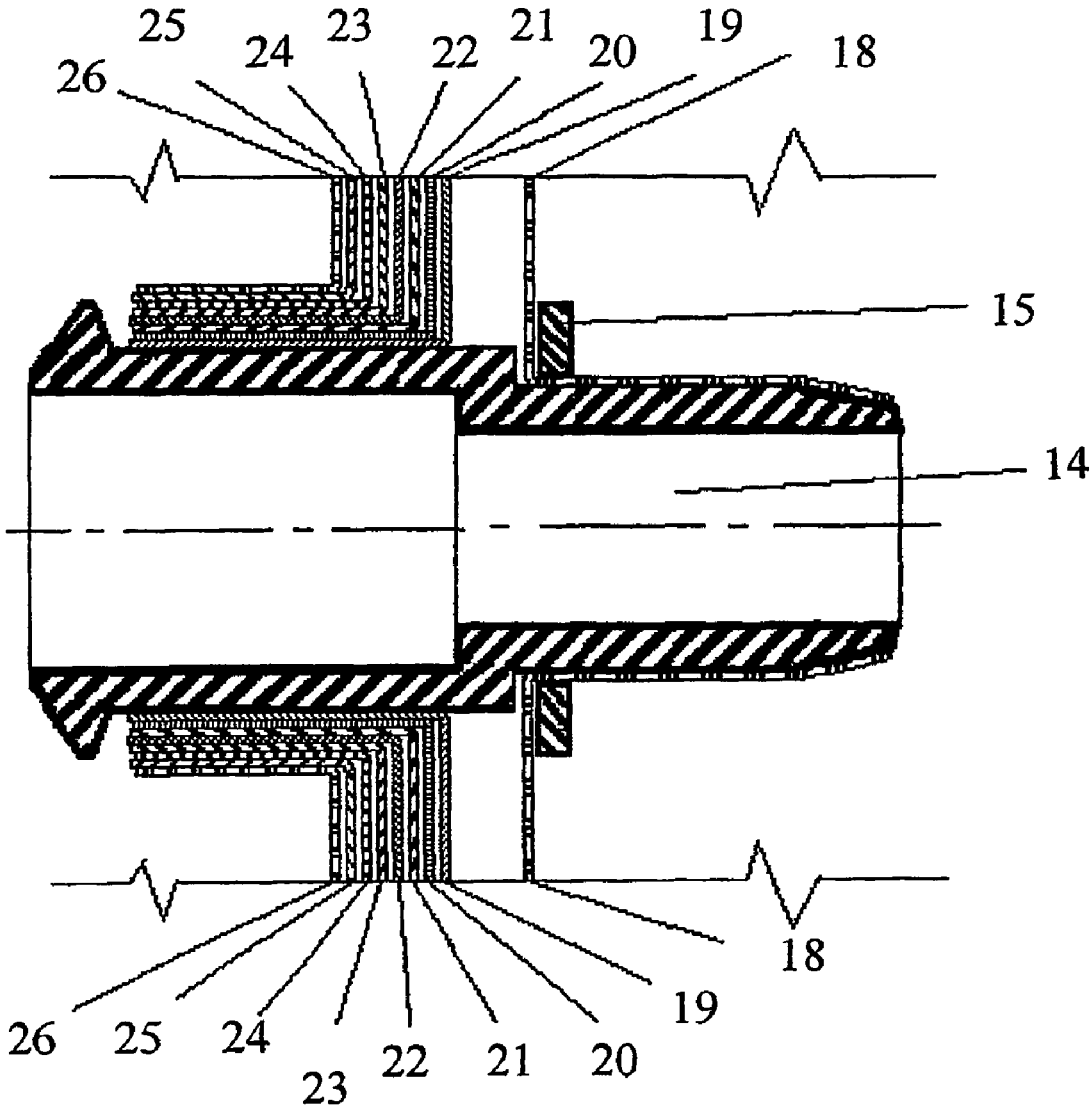
FIG. 7 is an enlarged sectional view AA of the hydraulic plant bag assembly of FIG. 5.

Referring to FIGS. 1-4 a bag assembly (1) is formed by multiple removable bags (10) (9) (8) (7) (6) (5), each one within the subsequent ones, except for the external bag (5), counting with the total or partial, if desired, expulsion of air between the bags and presenting procedures preventive of the attachment between bags in their lower extremities, so that the bag assembly (1), although used from within by means of the periodic removal of its innermost bag, maintains the quality of a single bag until it is used up.

The removal of the air between the bags of the bag assembly (1) is for the bag assembly (1) to have a malleability and rigidity similar to those of a bag as thick as the sum of the thickness of each individual bag of the bag assembly (1). Thus, during its placement in a container, when the walls of the set are pushed towards the container walls, the air will flow out of the container more easily due to the greater resistance.

The bag assembly (1) is configured to allow an innermost internal bag to be removed from the bag assembly without displacing an adjacent bag. The walls of the lower end of the bag are excessive in comparison with the shape of the lower end of the container. Each bag includes projections or excesses (3) extending outwardly from the lower end of the bag. The excesses (3) of all bags are considered together, depending on the shape of the bottom of the container, folding may take place in the area of the excesses (3) and hinder the bag's removal. In order to avoid this, the bags are disposed with an alternation of a 90 degree rotation (11), which is an adequate procedure to prevent the formation of excesses (3) in the lower end of the set of bags. Another adequate procedure is the modification of the lower end of the bags before placing them one within the others, in other words, to modify the shape of the lower end, thus eliminating excesses.

The advantages of the present invention, following the order of the technique presented above, are:

a) The container itself stores the bags; thus, there is no need to look for, fetch, and place each bag at a time;

b) The next bag to be used is already in place; thus, there is no need to look for the opening (2) of the bag, to open the bag, to place it inside the container, to push the walls of the bag towards the container walls, neither to adjust the upper edge of the bag to the container. Therefore, the difficulties associated to the operations just mentioned cease to exist;

c) The placement of the bag assembly (1) is easier and takes less time than the placement of only one bag at a time; the structure of the set of bags is more resistant to mild pressures, because there is very little air between the bags, which makes it easier to accommodate the walls of the set to the inner walls of the container;

d) Maintenance time is reduced;

e) There is a reduction in risks associated with inadequate body positions during longer periods of time.

When one observes the technique presently in use, one notices that, for the places mentioned in the present invention, there are no products available that are composed of multiple integrated bags for internal detachment in the handling steps.

The bag assembly (1) is proper for isolated places, such as trash cans. However, when the place is part of hydraulic plants, a hydraulic plant assembly bag "HP-bag assembly" (16) must have one or more lateral-openings (17), which must have impermeable or very little permeable fittings.

That is why technologies presented in publications PI9801250 and C19801250 exist for those cases in which bags with lateral openings are necessary.

The product of publications PI9801250 and C19801250 presents the option of placement of multiple bags in the container, what can be done before or after the container is sold, but it does not present the solution of multiple bags previously integrated with the placement in the container.

One problem resulting from the use of existing technologies has to do with the fitting of lateral openings of the HP-bag assembly (16), since the thickness of its walls is much greater than the thickness of each bag that comprises it, hindering manual fitting because it demands much physical effort or a fitting done individually per bag.

Referring to FIGS. 5-9, in order to integrate the present invention with PI9801250 and CI9801250 technologies, I created a bushing (14) with two fitting regions per internal fitting region (28) and an external fitting region (27). The internal region (28) is used for fitting and sealing between the set and the container, which can serve for the fitting of one external bag 18, resulting in the type of sealing mentioned in C19801250 and the external region (27) is used for fitting in the respective lateral opening of a set of bags in order to promote sealing when liquids flow from the more central bag to any of the subsequent bags of the HP-bag assembly (16), by means of the technique mentioned in PI9801250.

The advantage brought by the creation of the bushing (14) is exactly to enable the integration of previous technologies with that of the bag formed by the removable bags, so as to allow its use in hydraulic plants.

A single device, i.e., a bushing (14), intermediates two types of connections: one between the inner layers of the HP-bag assembly (16), and another between the external HP-bag (18) and the container.

Referring to FIG. 3, the best way to mount the bag assembly (1) is to prepare a support base (12), preferably in the shape of the interior of the container where the bag assembly (1) is to be placed, in other words, a base with external dimensions similar to the internal dimensions of the place where the bag assembly (1) will be used. The base (12) is positioned upside-down, and its height is supposed to be greater than the depth of the respective container. The base (12) will serve as a support and will occupy the inner space of the bag assembly (1) so that the air is expelled from the interior of the bag(s) (10) (9) (8) (7) (6) (5) which will cover it.

After the support base (12) is ready, the next step is to fit the innermost internal bag (10) so that it covers the base (12). Next, considering the hypothesis that there are excesses (3) of the walls of the internal bag (10) in its lower end, which is a very common situation, the user is to cover the internal bag (10) with the second bag (9), in a position different from the previous one, so that excesses (3) do not coincide, for example, turning the second bag (9) 90 degrees (11) in relation to the position of the internal bag (10), before placing one bag over the other. Thus, the fitting of the third bag (8) is done in the same position as the internal bag (10), and the fitting of the fourth bag (7) is done in the same position as the second bag (9), always alternating positions until all bags are placed and fitted one over the others. Now is the time to check for air between the bags, and if there is, to expel it. The bag assembly (1) is, then, ready. After that, in order for the bags (10) (9) (8) (7) (6) (5) of the bag assembly (1) to be more tightly together, the user folds the edge (13) of the opening (2) so as to keep the openings (2) of all subsequent (9) (8) (7) (6) (5) bags covered externally by the fold (13) of the internal bag (10). This fold (13) forces bags to be closer together, limiting the passage of air between them.

After being removed from the support base (12), the bag assembly (1) is ready to be placed in a container without a lateral opening, for example, a trash can, or ready to be folded and packaged for future use or sale. After the bag assembly (1) is placed in a trash can, the internal bag (10) that was fitted in the support base will be the first bag to be detached from the bag assembly (1); the second bag (9) that was fitted in the support base will be the second to be detached, and so forth.

More steps for the setting up of the HP-bag assembly (16) will be necessary if the container has lateral-opening(s) (17). In order to prepare each lateral-opening (17) of the HP-bag assembly (16), the user has to make a circular-opening in the HP-bag assembly (16), one whose diameter is smaller than the diameter of the corresponding external-fitting (27) of the bushing (14) to be placed.

Before the introduction of the bushing (14) into the circular-opening of the HP-bag assembly (16), one needs to make the edge of the circular-opening to work similarly to a rigid flat ring (15); this can be accomplished by pushing the walls of the bags of the HP-bag assembly (16) into a circumference of greater radius than the initial radius of the circular opening mentioned.

The next step is to move onwards an element that penetrates into the circular opening mentioned, following the direction of an axis perpendicular to the rigid flat ring (15), forcing the walls, generating internal tensions, so that the ring changes from flat to the shape of the base of a cone, i.e., the shape of the element mentioned.

Along with the element mentioned, the bushing (14) is moved so that it penetrates into the same opening, until all the opening is positioned in the external-fitting (27) of the bushing (14); as a result the opening no longer has the cone-base shape; now it has a cylindrical shape, which is the external shape of the bushing (14) where fitting takes place.

Considering the internal fitting (28) region of the bushing (14), the internal-fitting (28), I render best the configuration in which an external HP-bag is positioned externally to the other HP-bags (19) (20) (21) (22) (23) (24) (25) (26). In each lateral-opening (17) of this external HP-bag (18), the end of the respective bushing (14) is fitted and will serve to connect the HP-bag assembly (16) to the container, allowing for a better sealing in the connection. In order to assure that the external HP-bag (18) will not get loose, a ring (15) is placed to fix it in place.

Since sometimes containers have internal parts, for example, a trap connected to the outlet, I find it better the bushing (14) that has, in its end opposite to the insertion in inlet or outlet of container, an internal-diameter (29) that is equal to the internal diameter of the inlet or outlet of the container, so that, for example, the trap may be connected to the bushing instead of to the container.

Certainly, as it is clear for any expert in the field, the ways to represent the invention are not limited to the examples mentioned above and may vary according to the scope of claims attached. The mounting of the set of bags presented herein may be done manually or automatically.

The invention claimed is:

1. A bag assembly designed to be used in places that accumulate grit and dirt, the bag assembly comprising:

a set of bags including at least two internal bags within an external bag, the set of bags sized for lining a container;

at least one bushing projecting through a lateral opening of the bags for facilitating fluid communication through the bushing, the bushing being received by an inlet of the container for forming a seal, the at least one bushing having an elongate plastic tube with a longitudinal length, a diameter and a wall thickness, the tube provided with:

an internal fitting projecting outwardly along the length of the tube and through the lateral opening of the external bag, the internal fitting further extending through the container to connect to an external tube; and an external fitting projecting inwardly from the internal fitting, along the length of the tube and through the at least two internal bags to connect to an internal tube, the external fitting having a diameter that is greater than the diameter of the internal fitting, such that a step is formed at an interface between internal fitting and the external fitting;

a portion of the external bag extending outwardly from the circumference of the lateral opening and disposed over the outer diameter of the internal fitting;

a portion of the internal bags extending inwardly from the circumference of the lateral openings and disposed over the outer diameter of the external fitting; and a ring positioned axially adjacent to the step to encircle the circumference of the internal fitting and compressing the extended portion of the external bag there between for securing the bushing to the external bag;

wherein the bushing is configured for allowing an innermost internal bag and any collected grit and dirt therein to be selectively removed from the bag assembly while the bushing remains connected to the container.

2. The bag assembly according to claim 1 further comprising:

a seam extending transversely across a lower end of each bag of the set of bags, the seam forming at least one projection extending outwardly from the lower end of the bag;

wherein each bag is nested at an offset orientation relative to the adjacent bag or bags, thereby resulting in an offset of the projections to allow the innermost internal bag and any collected grit and dirt to be selectively removed from the bag assembly without displacing the adjacent bag, which can be further used.

3. The bag assembly according to claim 2 wherein a multilayered sidewall is formed by the nesting of the bags.

4. The bag assembly according to claim 3, wherein the bag assembly being positioned within a container such that the sidewall extends out of and folds over a circumferential edge of the container for supporting the bag assembly.

5. The bag assembly according to claim 1, wherein the at least one bushing further comprises a lip extending radially from the external fitting for retaining the internal bags to the bushing.

* * * * *